US006269549B1

(12) United States Patent
Carlucci et al.

(10) Patent No.: US 6,269,549 B1
(45) Date of Patent: Aug. 7, 2001

(54) DEVICE FOR DRYING HAIR

(75) Inventors: Vito Carlucci; Harold R. Taylor, both of Stratford; Sergio DaCosta, Danbury, all of CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 09/480,713

(22) Filed: Jan. 7, 2000

Related U.S. Application Data

(60) Provisional application No. 60/115,265, filed on Jan. 8, 1999.

(51) Int. Cl.[7] ..... A45D 24/10
(52) U.S. Cl. ..... 34/100; 34/101
(58) Field of Search ..... 34/97, 98, 99, 34/100, 101; 132/112, 212; 392/380, 384, 385

(56) References Cited

U.S. PATENT DOCUMENTS

| | | | | |
|---|---|---|---|---|
| 3,594,916 | | 7/1971 | Mason . | |
| 3,645,007 | | 2/1972 | Scott . | |
| 3,724,092 | | 4/1973 | McCleerey . | |
| 3,868,495 | | 2/1975 | Dyer . | |
| 3,981,314 | | 9/1976 | Barradas . | |
| 4,021,930 | | 5/1977 | Churas et al. . | |
| 4,038,759 | | 8/1977 | Dyer et al. . | |
| 4,118,874 | | 10/1978 | Morane . | |
| 4,413,428 | * | 11/1983 | Roos | 34/100 |
| 4,486,961 | * | 12/1984 | Giesselbach et al. | 34/100 X |
| 4,744,154 | * | 5/1988 | Bollinger et al. | 34/100 X |

* cited by examiner

*Primary Examiner*—Stephen Gravini
(74) *Attorney, Agent, or Firm*—Ohlandt, Greeley, Ruggerio & Perle, LLP

(57) ABSTRACT

A hair dryer in accord with the invention includes a hood, two staggered or asymmetrically placed fans in a base, and an airflow conduit therebetween. The hood of the device may also have an adjustable vent for regulating the amount of air delivered to the head. Moreover, the hood may be secured to the base so as to close the device into a compact form for carrying and storage.

18 Claims, 7 Drawing Sheets

DEVICE FOR DRYING HAIR

This Application claims priority from U.S. Provisional Application, Serial No. 60/115,265 filed Jan. 8, 1999.

FIELD OF THE INVENTION

The present invention relates generally to devices for drying the hair. More particularly, the present invention relates to hair dryers having a hood within which the user's head is placed.

DESCRIPTION OF THE PRIOR ART

Devices for drying the hair are well known in the art. It is also known in the art to provide hair dryers having hoods or bonnets that serve to direct the heated air used to dry the hair and scalp. The term hood is used herein to describe a rigid, dome-shaped receptacle that has a double-walled construction, wherein the inner wall has one or more air-discharge apertures.

Typically, a hood-type hair dryer includes a motor-driven fan unit for creating an air flow within the hair dryer, a device for heating the airflow (e.g., a heating coil), a hood within which the user's head is positioned, and a conduit directing the heated airflow into the hood.

The amount of time needed to dry a given amount of hair varies as a function of the both the temperature and volume of the air delivered by the hair dryer. The temperature of the air delivered by a hair dryer is limited by the comfort of the user to about 150° F., since experience shows that temperatures above 150° F. cause the hair that dries first to become uncomfortably warm while the user waits for the remaining hair to dry. On the other hand, the temperature of the air should be at least about 100° F. in order to provide an acceptable drying time.

The flow rate of the air delivered by a hair dryer is a parameter that is given considerable attention. Some methods for increasing flow rate are more effective than others. For example, enlarging the air inlet to the fan does not correspondingly increase the flow rate of air delivered by the fan because larger air inlets create more turbulence in the airflow. Moreover, practical constraints, such as size and weight, limit the flow rate of air that a hair dryer can deliver.

Thus, there remains a need for a hair dryer that increases the volume of delivered air, while maintaining comfort and convenience for the user.

Accordingly, it is an object of the present invention to provide a device for drying hair.

It is another object of the present invention to provide a hair drying device that can deliver an increased flow rate of air.

It is still another object of the present invention to provide a hair drying device that can deliver increased air volume and that allows that user to conveniently adjust the volume of air actually delivered.

It is a further object of the present invention to provide a hair drying device that is portable.

SUMMARY OF THE INVENTION

A hair dryer incorporating the invention includes a hood, two staggered or asymmetrically placed fans in a base, and an airflow conduit therebetween. The hood of the device may also have an adjustable vent for regulating the amount of air delivered to the head. Moreover, the hood may be secured to the base so as to close the device into a compact form for carrying and storage.

DETAILED DESCRIPTION OF THE INVENTION

Figure 1:
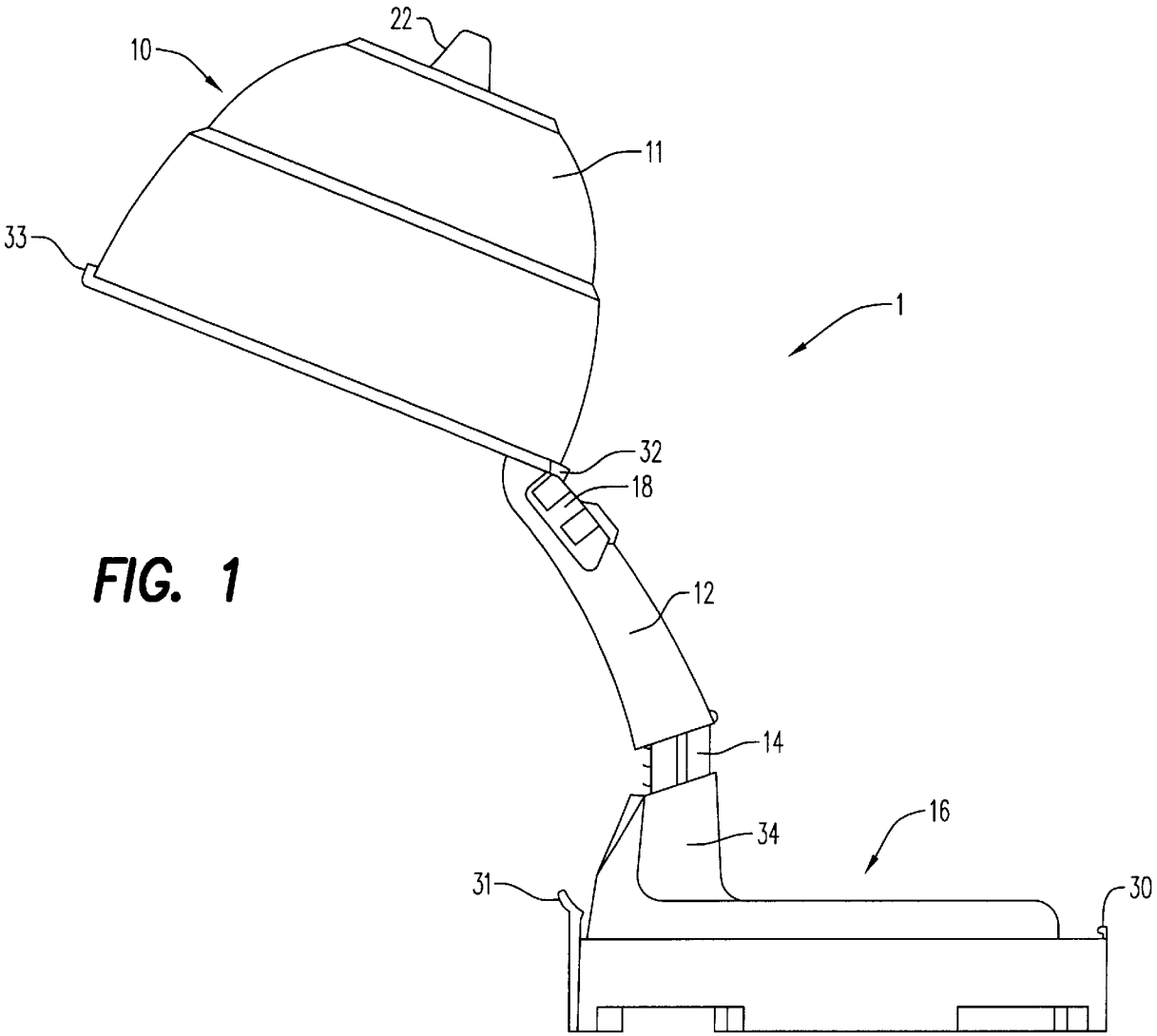
FIG. 1 is a left-side, plan view of a device for drying hair according to the present invention.

Referring to the drawings, and in particular FIG. 1, there is provided a device for drying hair, according to the present invention, indicated generally as 1. Device 1 comprises a hood 10, a pivoting arm 12, a telescoping arm 14, and a base 16. Hood 10 is pivotally coupled to pivoting arm 12 that is, in turn, pivotally supported on telescoping arm 14. Telescoping arm 14 is attached to base 16. Preferably, device 1 is constructed of a moldable material, such as a plastic.

Figure 2B:
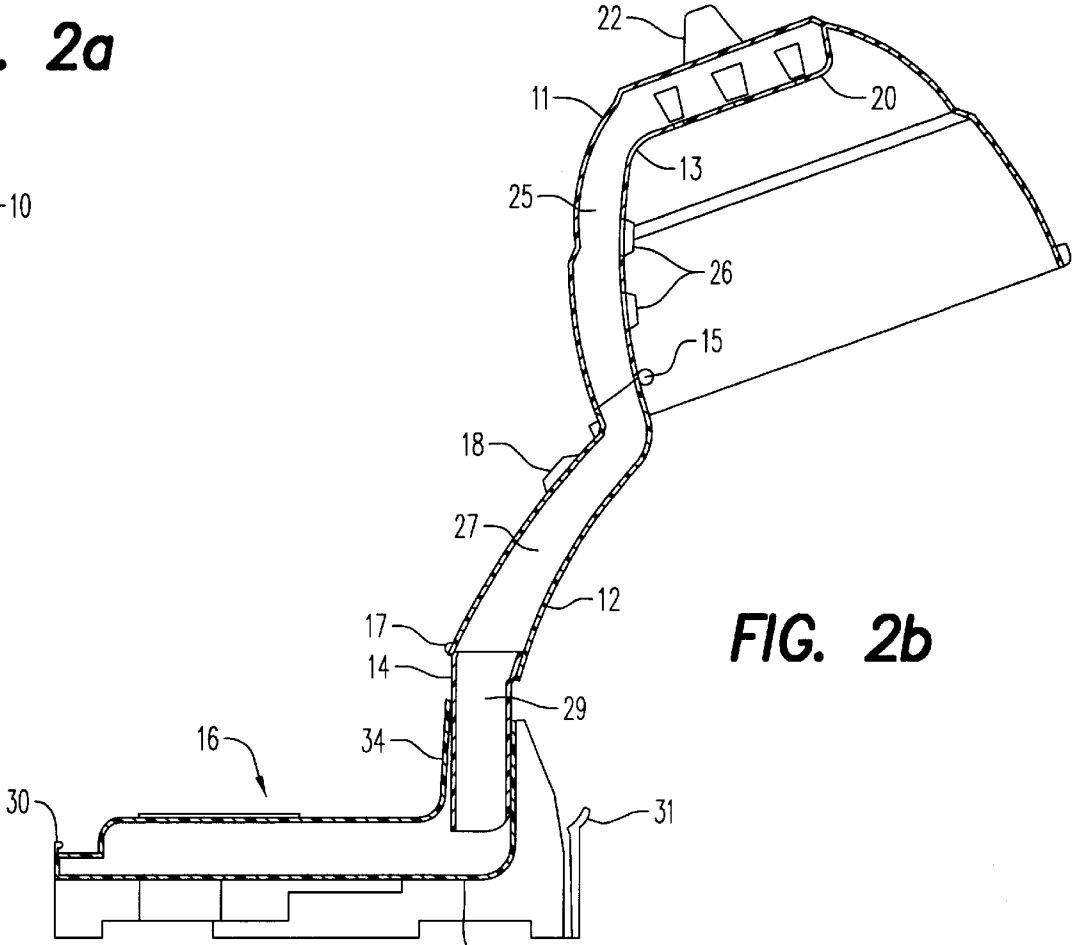
FIG. 2*b* is a right-side, cross-sectional view of the device of FIG. 1 along cross-section line A—A.
Figure 2A:
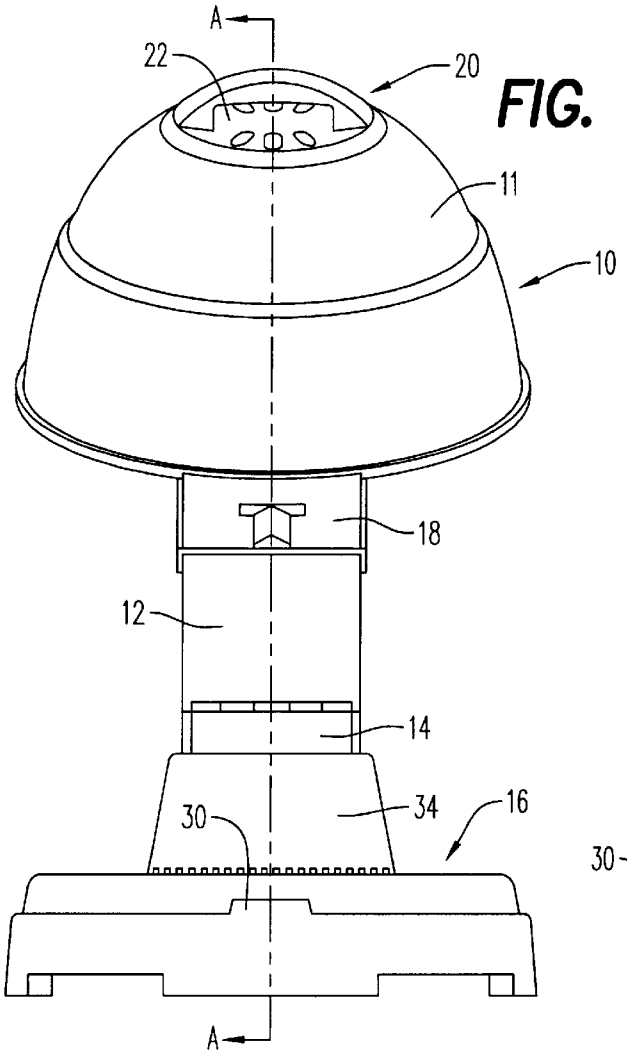
FIG. 2*a* is a rear, plan view of the device of FIG. 1, having cross-section line A—A.
Figure 3:
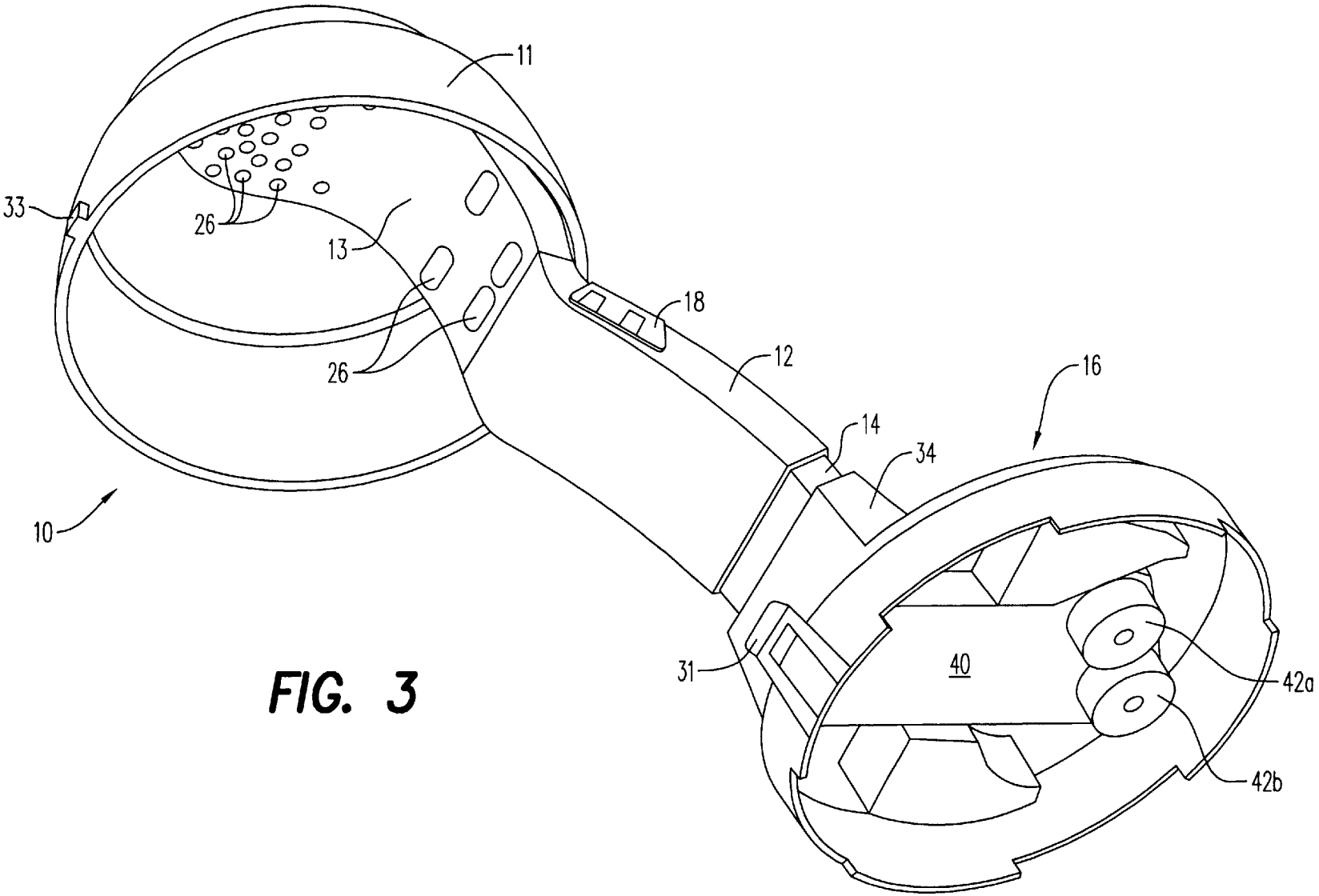
FIG. 3 is a perspective view from the underside of the device of FIG. 1.

FIG. 2*b* illustrates that hood 10 is a dome-shaped, generally single-walled receptacle that defines an interior space within which the user's head is placed. Hood 10 further comprises an exterior semi-spherical shell 11 and a partial inner wall 13 that, together, define a conduit 25. As illustrated in FIG. 2*b* and FIG. 3, inner wall 13 has a plurality of apertures, referred to generally as 26, that allow air to flow in a shower-like arrangement from conduit 15 into the interior space of hood 10.

Figure 4:
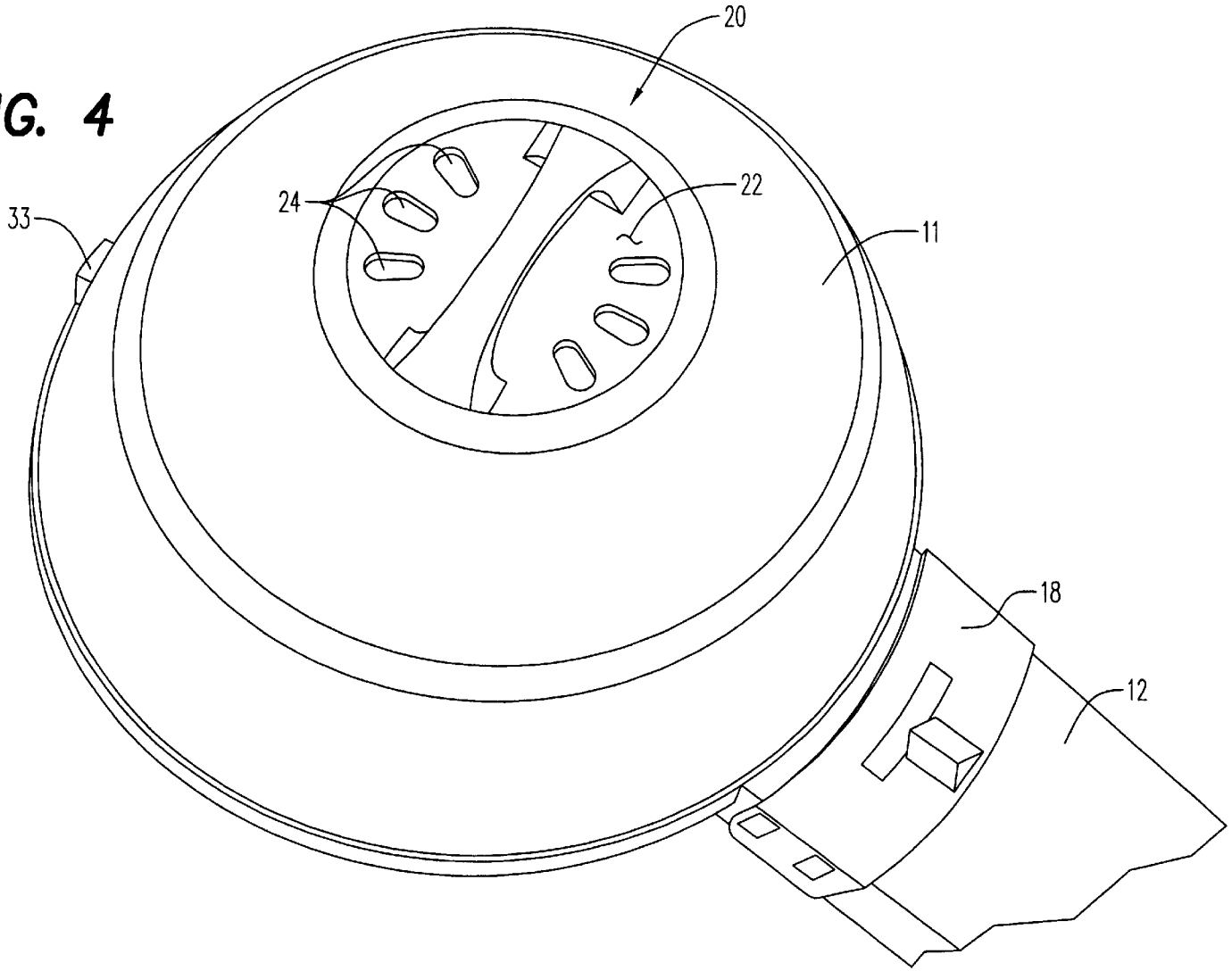
FIG. 4 is a perspective, detail view of the top of he device of FIG. 1, illustrating the adjustable vent hereof.

At the apex of hood 10, there is provided a vent 20. Vent 20 may be opened and closed for the purpose of regulating the flow rate of air from conduit 15 through the apertures 26. Opening and closing vent 20 is accomplished by hand-turning disc 22. Referring to FIG. 4, disc 22 has a plurality of vent holes, illustrated generally as 24. Likewise, shell 11 has a plurality of holes (not shown) that may be alternately covered and uncovered by disc 22. When vent 20 is in the open position, vents 24 are positioned over the holes in shell 11 and, thus, at least some of the airflow within conduit 15 is allowed to escape, instead of travelling through apertures 26. By contrast, when disc 22 covers the holes in shell 11, the fullest volume of air is delivered to the interior hood of 10.

Referring again to FIG. 1, the base of hood 10 is provided with ledges 32 and 33. Ledge 32 engages a sliding latch 18 for the purpose of locking hood 10 into the open position shown in FIG. 1. Ledge 32 may also engage a fixed latch 30 located on base 16 for the purpose of securing hood 10 to base 16 (in a manner to be described below). Likewise, when hood 10 is secured to base 16, ledge 33 engages a flexible latch 31 located on base 16.

Referring again to FIG. 2*b*, pivoting arm 12 is attached to hood 10 at hinge 15. Sliding latch 18, which is positioned on pivoting arm 12, is adapted to releasably engage ledge 32, whereby hood 10 can be releasably locked into the open position, as illustrated. Pivoting arm 12 has a generally tubular shape, therein forming a conduit 17. Conduit 17 is directed into conduit 15 when hood 10 is in the open position.

Telescoping arm 14, which is vertically adjustable, is connected to pivoting arm 12 at hinge 17. Like pivoting arm 12, fixed arm 14 has a generally tubular shape, therein forming a conduit 19. Conduit 19 is directed into conduit 17 when hood 10 is in the open position.

Figure 5:
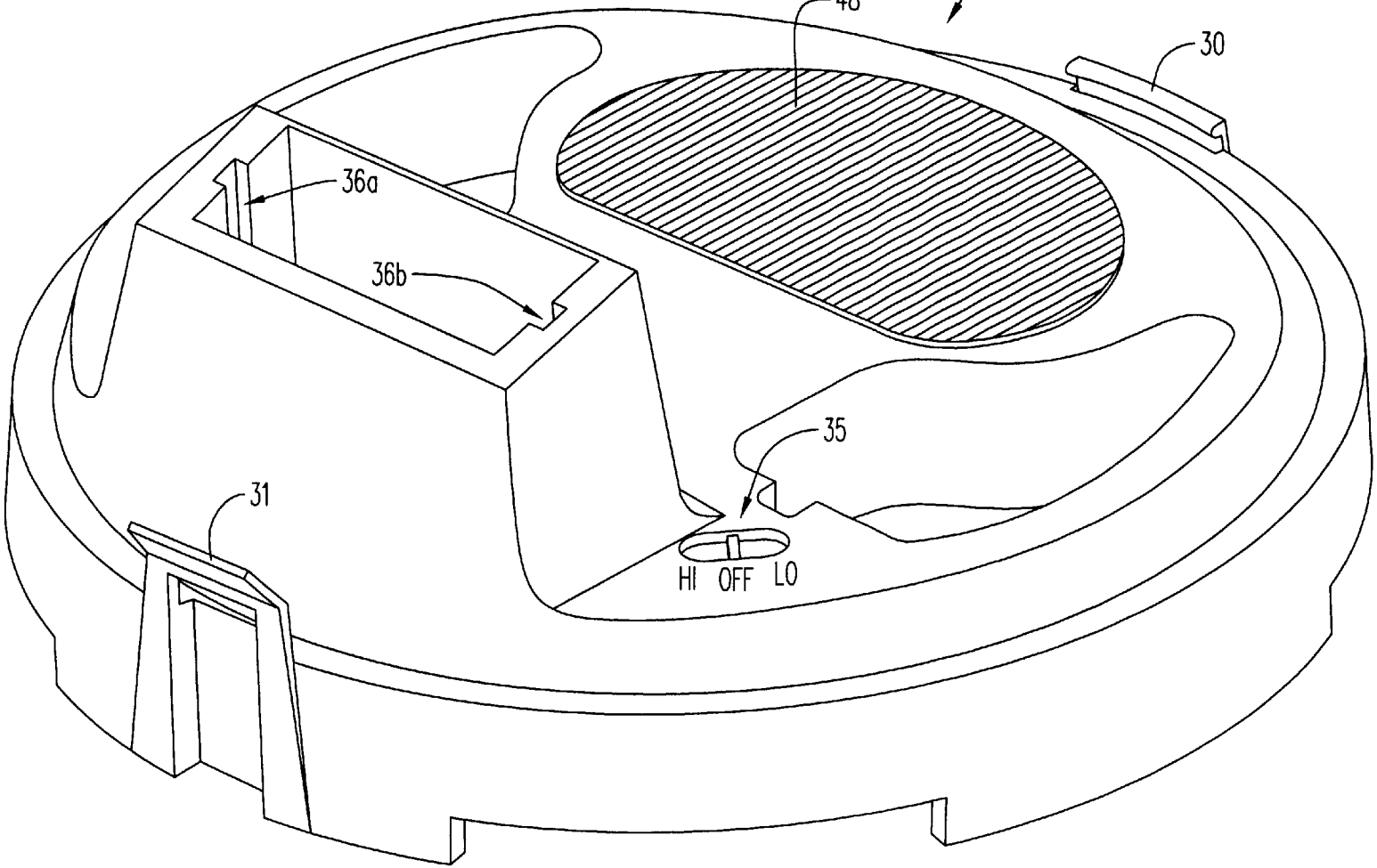
FIG. 5 is a perspective, detail view of the top of he base of the device of FIG. 1.

As illustrated in FIG. 3, base 16 comprises an upwardly directed sleeve 34 integrally connected to a duct 40. Sleeve 34 is adapted to receive telescoping arm 14. Duct 40 also defines lower air inlets 42*a*, 42*b* and upper air inlet 48 (see FIG. 5).

Figure 6:
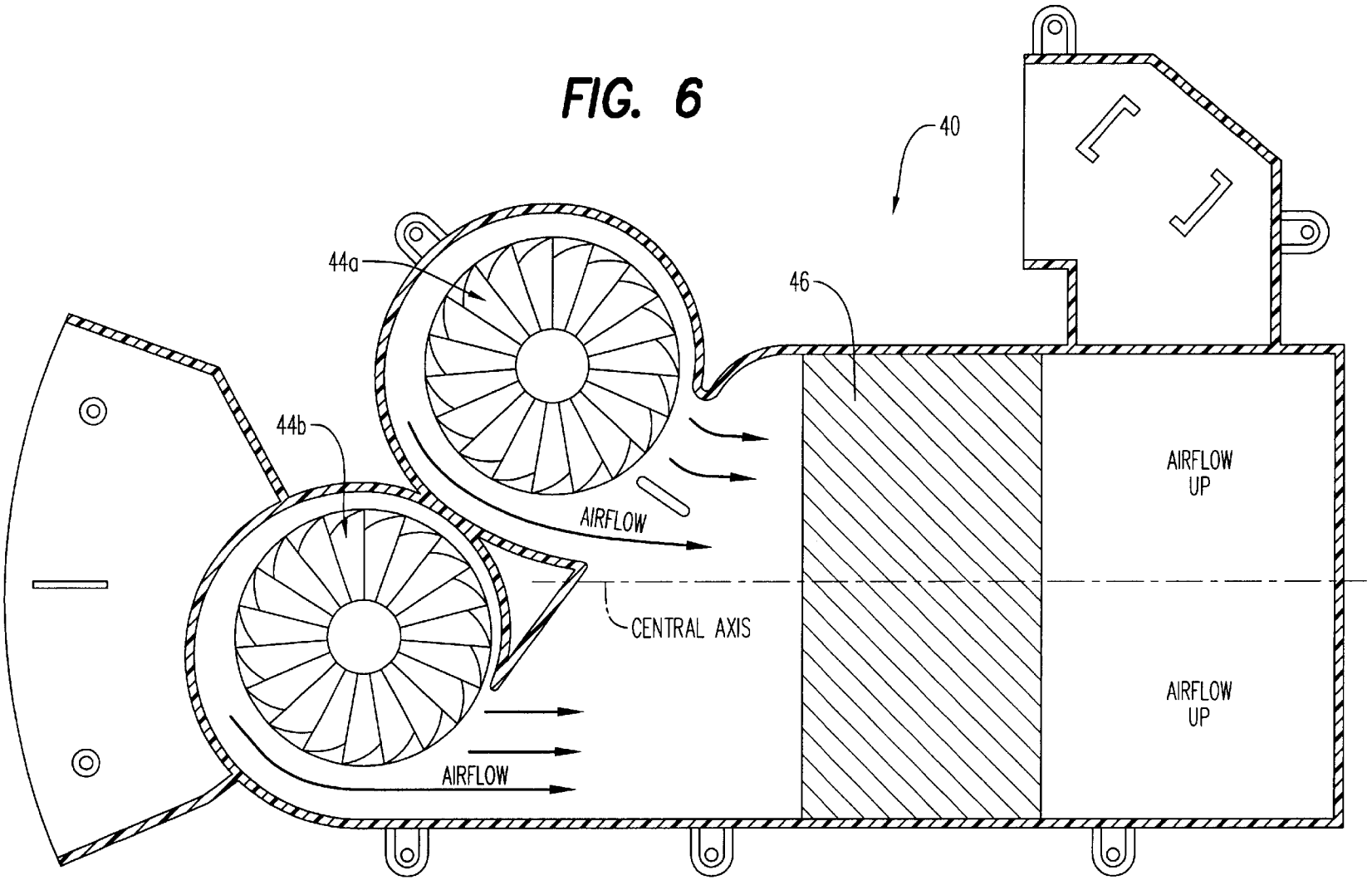
FIG. 6 is plan, detail view illustrating the interior of the airflow duct in the base of the device of FIG. 1.

Referring to FIG. 6, duct 40 has an elongated central axis and is adapted to contain fans 44*a*, 44*b* and electric heating element 46. Fans 44*a*, 44*b* create individual airflows, the paths of which overlap to create a combined airflow within duct 40 that passes over heating element 46 and up through sleeve 34 into conduit 19.

Fans 44*a* and 44*b* are staggered or asymmetrical relative to one another along the elongated central axis of duct 40. Accordingly, fan 44*a* is closer to heating element 46 and fan 44*b* is farther from heating element 46. Furthermore, the air flow paths from fans 44*a*, 44*b* overlap to create a combined airflow. The staggered arrangement further allows two fans to be fitted within duct 40, while minimizing the amount of lateral space required. Accordingly, base 16 may also be relatively smaller. The staggered arrangement also minimizes turbulence within the combined airflow created by fans 44*a* and 44*b* because of the smaller cross section of duct 40.

In operation, switch 35 (see FIG. 5) is moved from the "off" position to either the "Hi" or "Lo" positions and, thereby, fans 44*a* and 44*b* begin to rotate. The rotations of fans 44*a* and 44*b* create a combined airflow that pulls air into duct 40 from both above and below base 16, through respective air inlets 48 and 42*a*, 42*b*. Fans 44*a*, 44*b* then push the combined airflow through heating element 46. The combined airflow next enters sleeve 34, passes into conduit 19, through conduits 17 and 15, and, finally, into the interior of hood 10 through apertures 26. Vent 20 may allow a portion of the combined airflow to escape through shell 11, instead of apertures 26, depending upon which position the user places vent 20.

Figure 7:
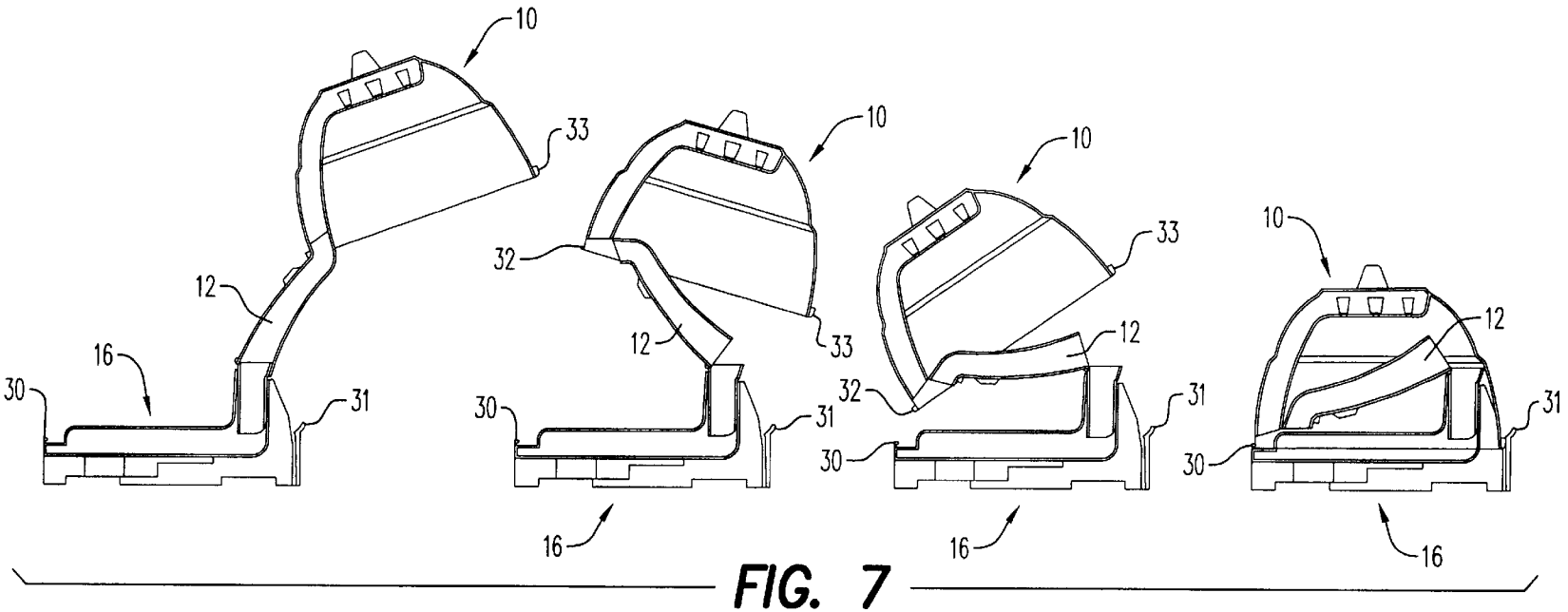
FIG. 7 is a progressive, plan, cross-sectional view along line A—A of the device of FIG. 1, illustrating the transition from fully open to fully closed.

FIG. 7 illustrates that the device of the present invention may be arranged in either an open position or in a closed position. To move device 1 from the closed position into the open position, flexible latch 31 is first pulled away from ledge 33. Hood 10 is then tipped back using fixed clasp 30 as a fulcrum. Once ledge 33 clears flexible latch 31, hood 10 may be pulled slightly away from fixed clasp 30, thereby releasing ledge 32. By continuing to pull hood 10 away from fixed clasp 30, pivoting arm 12 extends from a nested, substantially horizontal position to a substantially upright position. At this time, ledge 32 is adjacent pivoting arm 12. Thus, sliding latch 18 may by pushed against knob 32, thereby holding hood 10 in position relative to pivoting arm 12. In the open position, base 16 counterbalances hood 10, so that device 1 stays in an upright position. The process is reversed to move device 1 from the open position to the closed position The present invention having been described with particular reference to the preferred forms thereof, it will be obvious that various changes and modifications may be made herein without departing from the spirit and scope of the invention as defined in the appended claims.

We claim:

1. A device for drying hair comprising:

a hood defining an interior space, said hood having a plurality of apertures directed into said interior space;

a duct elongated along its central axis;

an airflow conduit between said duct and said apertures; and a plurality of fans, said fans being asymmetrically disposed within said duct along said central axis, each fan having a rotational axis and adapted to produce an individual airflow within said duct such that individual airflows produced by said fans at least partially overlap to form a combined airflow to said airflow conduit, hood, and apertures.

2. The device of claim 1, further comprising means disposed within said duct for heating said combined airflow.

3. The device of claim 1, wherein said rotational axes are arranged substantially perpendicular to said central axis of said duct.

4. The device of claim 1, wherein said hood comprises an inner wall and an outer shell, said apertures set through said inner wall, and said outer shell including means for adjustably venting at least a portion of said combined airflow away from said apertures.

5. The device of claim 4, wherein said means for adjustably venting comprises at least one hole set in said outer shell, said hole adjustably covered by movable obstruction means for regulating air flow through said hole.

6. The device of claim 1, further comprising means for latching said hood to said base.

7. The device of claim 6, wherein said means for latching comprises a flexible latch disposed on said base, a fixed latch disposed on said base, a first ledge disposed on said hood, and a second ledge disposed on said hood, said fixed latch adapted to releasably receive said first ledge and said flexible latch adapted to releasable receive said second ledge.

8. The device of claim 7, wherein said hood and said base are both hingedly connected to said airflow conduit, and wherein said airflow conduit nests within said interior space when said hood is latched to said base.

9. The device of claim 1, wherein said hood comprises an inner channel having a wall and an outer shell, said apertures set through said wall of said inner channel, and said outer shell including an adjustable vent means that communicates with said inner channel.

10. A device for drying hair comprising:

a hood defining an interior space, said hood having a plurality of apertures directing an airflow into said interior space; and adjustable vent means positioned in said hood for adjustably venting said airflow away from said apertures.

11. The device of claim 10, wherein said hood comprises an inner channel having a wall and an outer shell, said apertures set through said wall of said inner channel, and said outer shell including said adjustable vent means that communicates with said inner channel.

12. The device of claim 11, wherein said adjustable vent means comprises at least one hole set through said outer shell, and an adjustable cover for selectively covering or uncovering said at least one hole to regulate airflow therethrough.

13. The device of claim 10, further comprising:

a duct elongated along its central axis;

an airflow conduit between said duct and said apertures; and a plurality of fans, said fans being asymmetrically disposed within said duct along said central axis, each fan having a rotational axis, and each fan adapted to produce an individual airflow within said duct, wherein said individual airflows at least partially overlap to form a combined airflow to said airflow conduit, hood, and apertures.

14. The device of claim 13, further comprising means disposed within said duct for heating said combined airflow.

15. The device of claim 13, wherein said rotational axes are arranged substantially perpendicular to said central axis of said duct.

16. The device of claim 10, further comprising a means for latching said hood to said base.

17. The device of claim 16, wherein said means for latching comprises a flexible latch disposed on said base, a fixed latch disposed on said base, a first ledge disposed on said hood, and a second ledge disposed on said hood, said fixed latch adapted to releasably receive said first ledge and said flexible latch adapted to releasable receive said second ledge.

18. The device of claim 16, wherein said hood and said base are hingedly connected to said airflow conduit, and wherein said airflow conduit nests within said interior space when said hood is latched to said base.

* * * * *